US005813295A

United States Patent [19]

Jensen, Jr.

[11] Patent Number: 5,813,295

[45] Date of Patent: Sep. 29, 1998

[54] ROOFING MATERIAL REMOVAL TOOL

[76] Inventor: Emery W. Jensen, Jr., North 2863 County Hwy. "E", Merrill, Wis. 54452

[21] Appl. No.: 606,921

[22] Filed: Feb. 26, 1996

[51] Int. Cl.[6] ..... E04D 15/00

[52] U.S. Cl. ..... 81/45; 254/21; D8/88

[58] Field of Search ..... 81/45, 46; 254/17, 254/131, 131.5, 21, 25; 30/169–172; D8/88, 89, 9–11, 6

[56] References Cited

U.S. PATENT DOCUMENTS

| | | | |
|---|---|---|---|
| 29,984 | 1/1860 | Duffy | D8/89 |
| D. 265,791 | 8/1982 | Fieni | D8/88 |
| D. 270,895 | 10/1983 | Holloway | D8/89 |
| D. 277,359 | 1/1985 | Schiller | D8/89 |
| D. 293,412 | 12/1987 | Gonzales | D8/10 |
| D. 310,773 | 9/1990 | Frady | D8/89 |
| D. 319,953 | 9/1991 | Macha | D8/14 |
| D. 320,149 | 9/1991 | Owens | D8/89 |
| D. 327,206 | 6/1992 | Johnson | D8/14 |
| D. 356,482 | 3/1995 | Jensen, Jr. | D8/88 |
| 1,218,145 | 3/1917 | Whittier | 81/45 |
| 4,009,743 | 3/1977 | Ackerman | 81/45 |
| 4,086,699 | 5/1978 | Olkkola | 30/172 |
| 4,277,104 | 7/1981 | Sanchez | 299/37 |
| 4,324,042 | 4/1982 | Lipka et al. | 30/170 |
| 4,691,954 | 9/1987 | Shaud | 294/54.5 |
| 4,809,436 | 3/1989 | Crookston | 30/171 |
| 5,010,791 | 4/1991 | Williams | 81/45 |
| 5,076,119 | 12/1991 | Wenz | 81/45 |
| 5,165,659 | 11/1992 | L'Heureux | 254/17 |

*Primary Examiner*—D. S. Meislin
*Attorney, Agent, or Firm*—David L. Volk

[57] ABSTRACT

A roofing material removal tool is disclosed having a heavy weighted head pivotally affixed in an adjustable manner to an elongated handle. The head contains an incorporated fulcrum formed by an obtuse bend perpendicular to the axial center of the tool. The head has a blade edge having a plurality of spaced detentes, the detente separated from each other by an angular collecting notch which terminates in a bladed apex.

6 Claims, 4 Drawing Sheets

ROOFING MATERIAL REMOVAL TOOL

BACKGROUND OF THE INVENTION

1. Field of the Invention

The present invention relates generally to hand operated tools and, more particularly, to a hand operated tool specifically capable of aiding in the removal of roofing and shingle material.

2. Description of the Related Art

In the related art, many hand operated tools are known for aiding in the removal of shingles and other roofing material. However, many problems are associated with such designs, since many specialized problems can occur as a result of attempting to remove roofing materials. In roofing construction, roofing nails are typically used to retain flexible asphalt shingles to a plywood sub-roof. Tar paper or similar material is also placed between the plywood and shingle layers. The result is multiple layers of rigid and flexible material having a plurality of regularly spaced nails penetrating at right angles. Also, the standard placement for such roofing nails is approximately 12 inch intervals. And additionally, the variations in roof pitches as well as among the physical height of those working on them result in various needs that are difficult to adapt to with a non-adjustable tool.

Numerous failed attempts have been made to correct for the foregoing problems. For example, standard pry bar type tools have been found both tedious and inefficient in removing the outer surface of a large area such as the outer shingles of a roof. Additionally, such roofing surfaces tend to be a combination of nails as well as less rigid shingle material, the two materials tending to require different means of removal. One solution to such problems is typified in U.S. Pat. No. 5,010,791, issued in the name of Williams, wherein a shingle pry bar is disclosed combining a conventional pry bar with a thin, flat, extended diamond shaped forward blade portion.

In order to aid in the removal of nails, most roofing tools have accommodated detentes along the leading edge of the tool. For example, in U.S. Pat. No. 4,086,699, issued in the name of Olkkola, a roof stripping tool is disclosed having a plurality of "U"-shaped notches along a blade edge for capturing and gripping such roofing nails.

Also, in order to aid the introduction of a stripping tool under the many layers which comprise a roof, a thin blade has been often utilized. Additionally, in an attempt to increase efficiency, a blade width exceeding 12 inches has been attempted in order to provide for the catching and removal of multiple nails simultaneously. However, such attempts result in additional problems, such as tearing of the non-rigid roofing material and insufficient force to strip and remove the roofing nails.

Consequently, a need has been felt for providing an apparatus and method which can easily aid the user in removing both rigid and non-rigid roofing materials, as well as adapt to accommodate the multiple individualized scenarios which result in many particular roofing removal tasks.

SUMMARY OF THE INVENTION

It is therefore an object of the present invention to provide an improved roofing shingle removal tool.

It is another object of the present invention to provide an improved roofing shingle removal tool with sufficient strength and mass to easily penetrate or sever roofing nails.

It is another object of the present invention to provide an improved roofing shingle removal tool which has a self-fulcruming head to aid the user in the leveraged removal of roofing material.

It is yet another object of the present invention to provide an improved roofing shingle removal tool which can be adjustable in order to provide increasing leverage or access, or to otherwise accommodate a particularized roofing material removal task.

It is a feature of the present invention to provide an improved roofing material removal tool having a multi-position, pivoting, removable head which can be adjusted to change the angle between the head and an extended handle.

Briefly described according to the preferred embodiment of the present invention, a roofing material removal tool is disclosed having a heavy weighted head pivotally affixed in an adjustable manner to an elongated handle. The head contains an incorporated fulcrum formed by an obtuse bend perpendicular to the axial center of the tool. The head has a blade edge having a plurality of spaced detentes, the detente separated from each other by an angular collecting notch which terminates in a bladed apex.

An advantage of the present invention is that the heavy weighted head increases forward momentum and thereby aids in the gathering and severing of roofing nails.

Another advantage of the present invention is that the incorporated fulcrum provides both a fulcrum available for providing leverage to nails or rigid roofing material, while at the same time providing a sloped, angular path for discharging pliable roofing material.

Another advantage of the present invention is that the head is adjustable to multiple positions, thereby providing various incident angles for the head or positions for leverage for the user.

Further, a preferred embodiment of the present invention has an elongated handle, allowing for both the application of leverage upon the head as well as a means for easily transporting loosened roofing material in a shovel-like manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
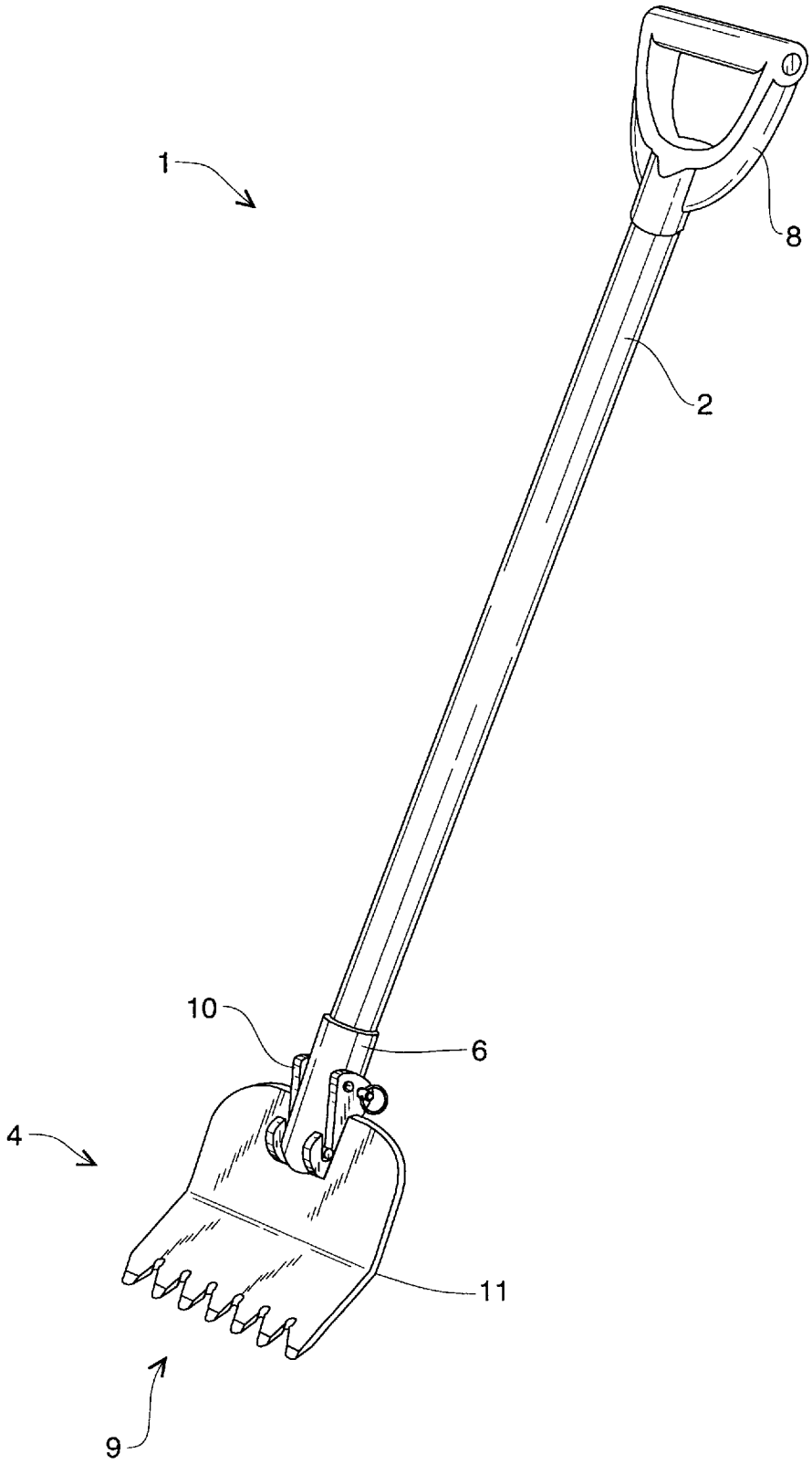
FIG. 1 is an orthographic view of a roofing material removal tool according to the preferred embodiment of the present invention.

Referring now to FIG. 1, a roofing material removal tool 1 is shown, according to the present invention, having a handle 2 pivotally affixed to a head 4. The handle 2 is elongated, and is terminated on one end by a collar 6 and the other end by a grip 8. Details of the collar 6 are more clearly described in FIG. 2A and FIG. 2B, below. It has been found that in its preferred embodiment, a standard "D" shaped grip 8 being utilized in conjunction with a sufficiently long handle 2 provides the user with the ability to easily manipulate the tool 1 in a manner similar to that of a conventional short-handled shovel, thereby providing the easy application of force to the head 4 for purposes of stripping and prying as well as for removal of loosened material. The head 4 has a blade edge 9, a pivotal connection means 10 for connecting to said collar 6, and an incorporated fulcrum 11 between the blade edge 9 and pivotal connection means 10. It has been found that in its preferred embodiment, a relatively heavy and narrow head 4 has advantages over the thin, light, and wider embodiments available in the prior art. The head 4 will be described in greater detail in FIG. 3, along with such advantages.

Figure 2A:
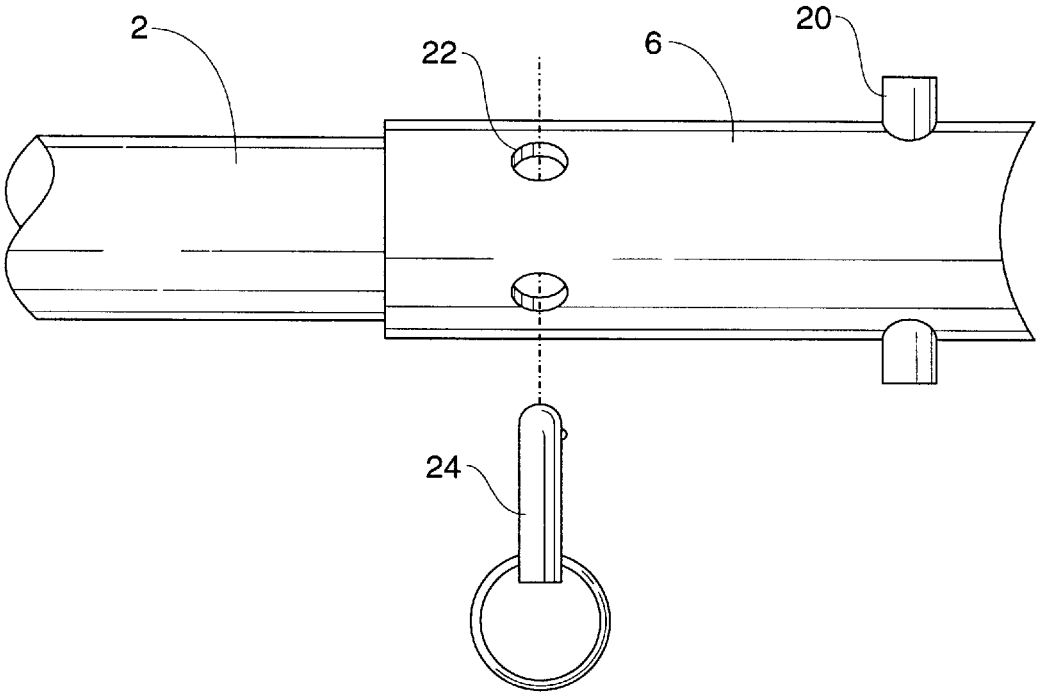
FIG. 2A is a partial top plan view of a handle for use with the preferred embodiment of the present invention.
Figure 2B:
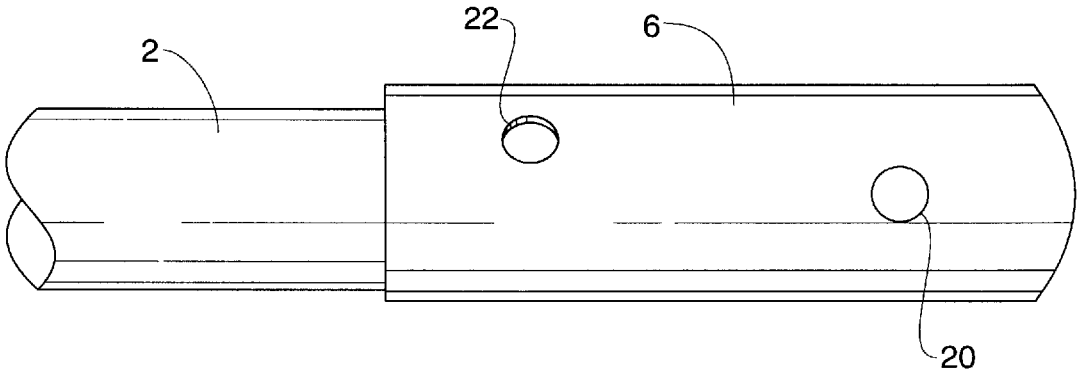
FIG. 2B is a partial side plan view thereof.

Referring to FIG. 2A and FIG. 2B, the handle 2 is shown terminated in a collar 6. In its preferred embodiment, the handle 2 is formed from a wooden dowel or a fiberglass rod, both of which are lightweight, readily available, and of sufficient strength, and can therefore be received into a collar 6 formed of standard metal pipe material to provide the added strength required due to concentration of forces at or near the pivotal connection means. However, it is also envisioned that the handle 2 and collar 6 could be easily combined as a single unit, such as being formed of a continuous length of standard metal pipe material, for example. In the preferred embodiment, the collar 6 supports a pivot pin 20 which is aligned along the axial center of the handle 2 and collar 6, and protrudes outward from the collar 6. Additionally, a receiving hole 22 is formed by and penetrates the collar 6 at a point along the collar 6 spaced apart from the pivot pin 20 and offset from the axial centerline of the collar 6 and handle 2. A position locking means 24 is provided which is received by and penetrates the receiving hole 22. As shown, a position locking means comprising a quick release pin is utilized in the preferred embodiment for providing a rigid and secure locking means 24 that can be detached and reattached quickly and easily. However, many conventional methods can be utilized, such as screws, bolts, and the like, in order to releasingly penetrate the receiving hole 22.

Figure 3A:
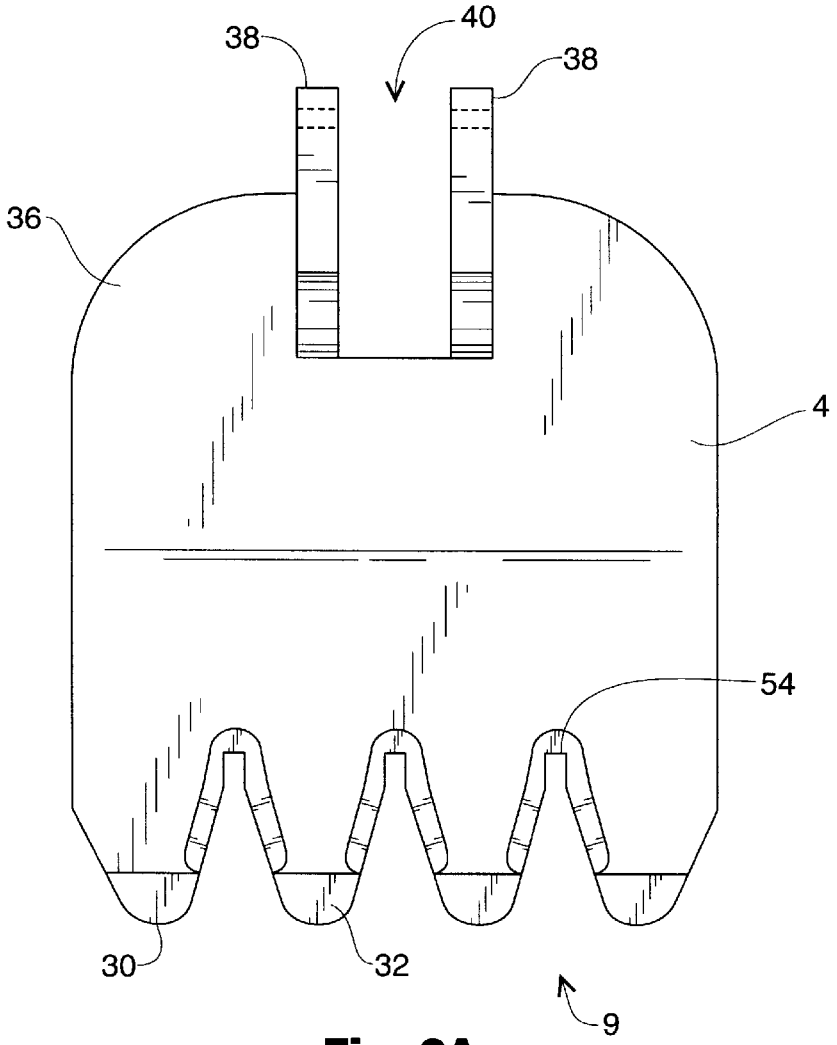
FIG. 3A is a top plan view of a head for use with the preferred embodiment of the present invention.
Figure 3B:
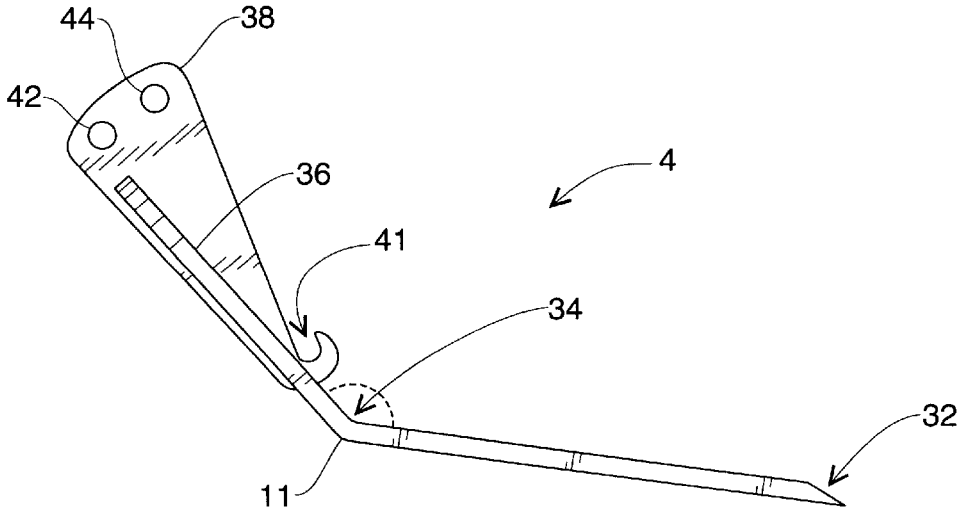
FIG. 3B is a side elevational view thereof.

FIG. 3A and FIG. 3B show the head 4 having a blade edge 9 forming a plurality of detentes 30. Each detente 30 is tapered, forming a first blade surface 32 along the detente surface back to the apex 54. The detentes 30 are thereby directed below flat roofing materials by their first blade surfaces 32, and penetrate layers of either rigid or flexible roofing material such as plywood, tar paper, shingles, and the like. The incorporated fulcrum 11 is formed integrally as part of the head 4, and forms an obtuse bend 34 between the blade edge 9 and a head upper section 36. As the blade edge penetrates roofing material and releases it from a structure, the head upper section 36 form a guide, further lifting and removing such material. It is presently envisioned that a heavy, rigid material, such as plate steel, be utilized to form the head 4 for a variety of reasons. First, the head upper section 36 will tend to increase frictional drag during use. Additional overall weight for the head 4 will in general provide the user with additional inertia in order to overcome heavy loading of the tool 1. Also, the use of a heavy, rigid material allow the incorporated fulcrum 11 to sustain the tremendous amount of leverage that will be applied to the blade edge 9 by the handle 2. Plate steel has been found to be easy to utilize in manufacturing while at the same time adequately sustaining such usage.

Affixed at the head upper section 36 are a pair of guide ears 38 mounted paralleling on each side of a handle receiving notch 40. Each guide ear 38 forms a pivot pin retaining hook 41 for receiving the pivot pin 20 (as shown in FIG. 2A and 2B) such that the head 4 can be linearly aligned with and along the axial center of the handle 2 at the pivot pin 20. Each guide ear 38 further has a first positioning hole 42 and a second positioning hole 44 aligned in an axially offset manner from the axial centerline of the handle 2. The head 4 thereby pivots at the pivot pin 20. Also, the head 4 is held in one particular position when the position locking means 24 is inserted through a positioning hole, the receiving hole 22 in the collar 6, and then the other corresponding positioning hole, respectively. This arrangement provides a adjustability of the head 4 in four separate positions relative to the handle 2, one each via the first positioning hole 42 and the second positioning hole 44 with the handle 2 in a first position, and two more by rotating the handle 2 by 180 degrees. This is a result of the offsetting of the receiving hole 22, as described above.

Figure 4:
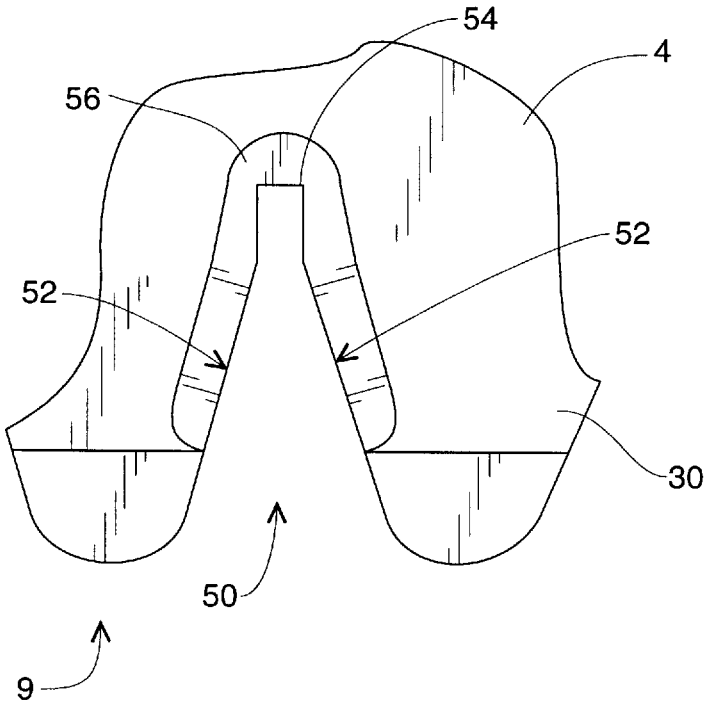
FIG. 4 is a detailed partial view of a blade edge thereof.

As shown in FIG. 4, the details of the blade edge 9 are shown. Each pair of detentes 30 are separated by a collecting notch 50. The collecting notch 50 is formed as an acute angle between the detentes 30, and functions as a guide when the tool 1 perpendicularly encounters a nail or other similar rigid material. The collecting notch 50 guides the head 4 along a nail such that the nail passes along the notch side 52 to the apex 54. Located at the apex 54 is a second blade 56, which is appropriately positioned to sever the nail or other object in a smooth, even motion, without interference with the lifting motion the blade edge is engaged in while lifting the flat roofing material. Such a design allows the user to utilize a continuous, shoveling motion in order to both lift roofing materials as well as sever the nails holding those materials.

The foregoing description is included to illustrate the operation of the preferred embodiment and is not meant to limit the scope of the invention. It would be obvious to one skilled in the art that many minor changes could be made to the disclosed roofing material removal tool within the intent of the present disclosure. Therefore, the scope of the invention is to be limited only by the following claims.

What is claimed is:

1. A roofing material removal tool comprising:

an elongated handle;

a head;

said handle including a first end terminated by a collar, and a second end;

a pivot pin affixed to and aligned along the axial center of said collar and protruding outward from said collar;

a receiving hole formed by and penetrating said collar at a point along said collar spaced apart from said pivot pin and offset from the axial centerline of said collar and handle; and position locking means for being received by and penetrating said receiving hole.

2. The tool as described in claim 1, wherein said position locking means comprising a quick release pin.

3. The tool as described in claim 1, wherein said head comprises:

a blade edge opposite said pivotal connection means, said blade edge forming a plurality of detentes, each said detente being tapered and forming a first blade surface; and an integral fulcrum formed between said blade edge and said pivotal connection means, said integral fulcrum formed integrally as part of said head, said fulcrum further forming an obtuse bend between said blade edge and a head upper section.

4. The tool as described in claim 3, wherein said head is formed of plate steel material.

5. The tool as described in claim 1, wherein said handle is formed of fiberglass material.

6. The tool as described in claim 3, wherein said pivotal connection means comprises:

a pair of guide ears mounted parallel on each side of a handle receiving notch formed by said head upper section, each said guide ear forming a pivot pin retaining hook for receiving said pivot pin such that said head can be linearly aligned with and along the axial center of said handle at said pivot pin;

a first positioning hole formed within said guide ear in an axially offset manner from the axial centerline of the handle for receiving said position locking means; and a second positioning hole formed within said guide ear in an aligned manner to said first positioning hole and in an axially offset manner from the axial centerline of the handle for receiving said position locking means in a plurality of aligned orientations.

* * * * *